US006220890B1

(12) United States Patent
Turek et al.

(10) Patent No.: US 6,220,890 B1
(45) Date of Patent: Apr. 24, 2001

(54) ELECTRICAL SWITCH CONNECTOR ASSEMBLY

(75) Inventors: James A. Turek, LaGrange; Kenneth G. Irish, Chicago, both of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/276,193

(22) Filed: Mar. 25, 1999

(51) Int. Cl.[7] ..... H01R 4/24; H01R 4/26; H01R 11/20; H01R 13/58

(52) U.S. Cl. ..... 439/459; 439/404

(58) Field of Search ..... 439/459, 456, 439/404, 405, 701

(56) References Cited

U.S. PATENT DOCUMENTS

| | | | | |
|---|---|---|---|---|
| 3,985,416 | | 10/1976 | Dola et al. . | |
| 4,113,340 | | 9/1978 | Rapata . | |
| 4,113,341 | | 9/1978 | Hughes . | |
| 4,206,962 | | 6/1980 | Shue, Jr. et al. . | |
| 4,272,147 | | 6/1981 | Berglund et al. . | |
| 4,413,871 | | 11/1983 | Swengel, Jr. . | |
| 4,538,873 | * | 9/1985 | Worth | 439/456 |
| 4,552,429 | | 11/1985 | van Alst . | |
| 4,952,169 | | 8/1990 | Hayes, Sr. . | |
| 5,009,612 | | 4/1991 | Rishworth et al. . | |
| 5,026,305 | | 6/1991 | Del Guidice et al. . | |
| 5,199,899 | | 4/1993 | Ittah . | |
| 5,338,220 | | 8/1994 | Soes et al. . | |
| 5,397,251 | | 3/1995 | Kaminski . | |
| 5,435,754 | | 7/1995 | Hotea et al. . | |
| 5,573,432 | * | 11/1996 | Hatagishi | 439/459 |
| 5,647,761 | | 7/1997 | Kaminski . | |
| 5,651,692 | * | 7/1997 | Hatagishi | 439/459 |
| 5,713,756 | * | 2/1998 | Abe | 439/404 |

* cited by examiner

*Primary Examiner*—Paula Bradley
*Assistant Examiner*—Shanetta D. Ore
(74) *Attorney, Agent, or Firm*—Schwartz & Weinrieb

(57) ABSTRACT

An electrical switch connector assembly, for mating with an electrical switch, comprises a housing having a plurality of electrical contact members disposed therein, wherein each one of the contact members have insulation-piercing members formed upon first end portions thereof for engaging electrical wires, and leaf-spring members formed upon second end portions thereof for engaging prong contact members of the electrical switch. A cover member is snap-engagingly mounted upon the housing so as to cooperate with the housing in retaining the electrical wires mounted therein, and a strain relief member is also snap-engagingly mounted upon the housing so as to co-operate with the cover member in providing strain-relief characteristics to the electrical wires.

18 Claims, 7 Drawing Sheets

ELECTRICAL SWITCH CONNECTOR ASSEMBLY

FIELD OF THE INVENTION

The present invention relates generally to electrical connectors, and more particularly to an electrical switch connector assembly which is intended to be used in conjunction with any one of a plurality of different microswitches, which comprises a housing within which there is provided a plurality of insulation-displacement type contacts upon which a plurality of electrical wires are adapted to be terminated, mounted, or secured, and which is provided with a unique and novel strain relief structure which is mounted upon the housing for providing strain relief characteristics to the plurality of wires secured, mounted, or terminated upon the insulation-displacement type contacts of the housing.

BACKGROUND OF THE INVENTION

Electrical switch connector assemblies are of course well-known in the art. In accordance with the principles and teachings of one well-known PRIOR ART electrical switch connector assembly as illustrated in FIG. 1, the structure of such electrical switch connector assembly, which is generally indicated by the reference character 10, comprises a housing 12 which is manufactured by AMP CORPORATION and within which there is defined a pair of receptacles 14,16. In turn, there is respectively inserted, within each one of the pair of receptacles 14,16 a spade-type connector contact, not shown, having an electrical wire 18,20 secured, by a means of a suitable crimping operation, upon the non-spade end thereof.

The housing 12 further comprises a third receptacle 22 which is axially offset with respect to the aforenoted pair of receptacles 14,16 and which is adapted to house a third common or ground spade-type connector contact, also not shown. The non-spade end of the third common spade-type connector contact has a first end of a third electrical wire 24, also connected thereto by means of a suitable crimping operation, while a second opposite end of the third electrical wire 24 is adapted to be connected to, for example, the second one of the pair of spade-type connector contacts disposed within the pair of receptacles 14,16 and to which the second one 20 of the pair of electrical wires 18,20 is already connected. It is also noted that the portion of the housing 12 within which the third receptacle 22 is defined is partially separated from the portion of the housing 12 within which the first and second receptacles 14,16 are defined by means of an axially extending slot 26 such that the third receptacle portion of the housing 12 is in effect flexibly mounted upon the main housing portion, within which the receptacles 14,16 are defined, in a cantilevered manner. This housing structure permits the spade-end contact portions of the electrical switch connector assembly 10 to be electrically connected to any one of various microswitch elements or components despite the fact that the electrical contacts of such microswitch elements or components, which are adapted to electrically mate with or engage the electrical contacts of the assembly 10, may be somewhat different or vary in configuration with respect to each other.

While the aforenoted well-known PRIOR ART electrical switch connector assembly 10 has of course exhibited suitable service and has been commercially successful, such PRIOR ART electrical switch connector assembly 10 also exhibits several operational and assembly drawbacks or disadvantages. For example, each one of the spade-type connector contacts of the electrical switch connector assembly 10 must be individually crimped onto the end portions of the electrical wires 18,20,24. In addition, each one of the spade contact-electrical wire assemblies, comprising the electrical wires 18,20,24 and their respective spade-type connector contacts crimped thereon, must be individually manually inserted within a particular one of the housing receptacles 14,16,22. Not only are such individual assembly operations time-consuming and tedious, but in addition, it is difficult to ensure that the crimping operations of the spade-type connector contacts upon the electrical wires 18,20, 24 are always properly performed. Still further, it must be additionally ensured that the proper spade contact-electrical wire assemblies are inserted within the proper receptacles 14, 16,22 in order to, in turn, ensure the fact that the switch-connector assembly has its electrical paths properly routed. Still further, it is additionally noted that the electrical switch connector assembly 10 is not provided with any strain relief means so as to prevent undue strains or stresses from being impressed upon the electrical wires 18,20,24 and their associated spade-type connector contacts. The impression of such strains or stresses upon the electrical wires 18,20,24 and their associated contacts could possibly lead to disengagement or disconnection of the wires 18,20,24 from their associated contacts with obvious deleterious effects upon the associated switch and the machinery or equipment within which such components are installed.

A need therefore exists in the art for a new and improved electrical switch connector assembly which is readily capable of being easily assembled, which can be assembled by automated machinery, which is capable of being mated, engaged, or operatively connected with several different switch elements or components, and which comprises strain relief structure so as to effectively prevent strains or stresses impressed upon the electrical wires from being transmitted directly to the connection points or locations defined between the wires and the electrical switch connector contacts.

OBJECTS OF THE INVENTION

Accordingly, it is an object of the present invention to provide a new and improved electrical switch connector assembly.

Another object of the present invention is to provide a new and improved electrical switch connector assembly which effectively overcomes the various operational and assembly disadvantages and drawbacks characteristic of the PRIOR ART electrical switch connector assemblies.

An additional object of the present invention is to provide a new and improved electrical switch connector assembly which is readily capable of being easily assembled, at least partially by automated machinery, and which is capable of being of being mated, engaged, or operatively connected with several different types of switch elements or components.

A further object of the present invention is to provide a new and improved electrical switch connector assembly which comprises strain relief structure so as to effectively prevent strains or stresses, which may be impressed upon the electrical wires, from being transmitted to the connection locations or points at which the wires are connected to the electrical switch connector contacts.

SUMMARY OF THE INVENTION

The foregoing and other objectives are achieved in accordance with the teachings and principles of the present invention through the provision of a new and improved electrical switch connector assembly which comprises a housing within which three receptacles are defined. Electrical switch connector contacts are respectively disposed within the three receptacles, and the electrical switch connector contacts have insulation displacement or piercing contact portions formed at respective first ends thereof for mating with and mounting the electrical wires thereon, and leaf spring contact portions formed at respective second ends thereof for mating with tab or prong members of a suitable electrical switch with which the electrical switch connector assembly is adapted to be mated.

A cover member is snap-fitted upon the housing so as to effectively close the ends of the housing receptacles within which the electrical wires are mounted and disposed, and a strain relief member is also snap-fitted upon the housing so as to effectively cooperate with the cover member in providing strain relief characteristics to the assembly whereby strains or stresses which may be impressed upon the electrical wires are effectively prevented from being transmitted to the connection points or locations at which the electrical wires are connected to the electrical switch connector contacts. The assembly housing is also divided into two portions with the common or ground housing portion being resiliently and flexibly mounted upon the main housing portion in a cantilevered manner so as to permit the electrical switch connector assembly to be readily used in combination with different switch mechanisms, elements, or components which may have slightly different tab or prong configurations or size dimensions.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
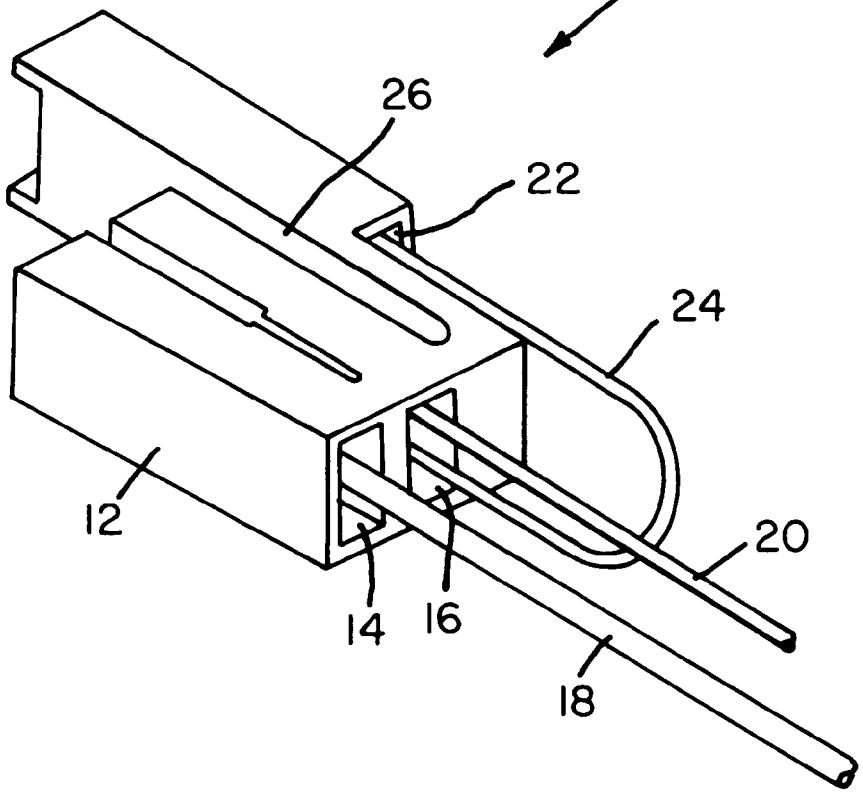
FIG. 1 PRIOR ART
FIG. 1 is a perspective view of a known PRIOR ART electrical switch connector assembly.

Referring now to the drawings, and more particularly to FIGS. 2–5 thereof, the new and improved electrical switch connector assembly, constructed in accordance with the principles and teachings of the present invention and showing the cooperative parts thereof, is generally indicated by the reference character 110. It is to be noted that parts of the new and improved electrical switch connector assembly of the present invention, which generally correspond to similar parts of the known PRIOR ART electrical switch connector assembly 10 shown in FIG. 1, will be designated by similar reference characters except that the reference characters designating the parts of the new and improved electrical switch connector assembly of the present invention will be within the 100 series.

Figure 2:
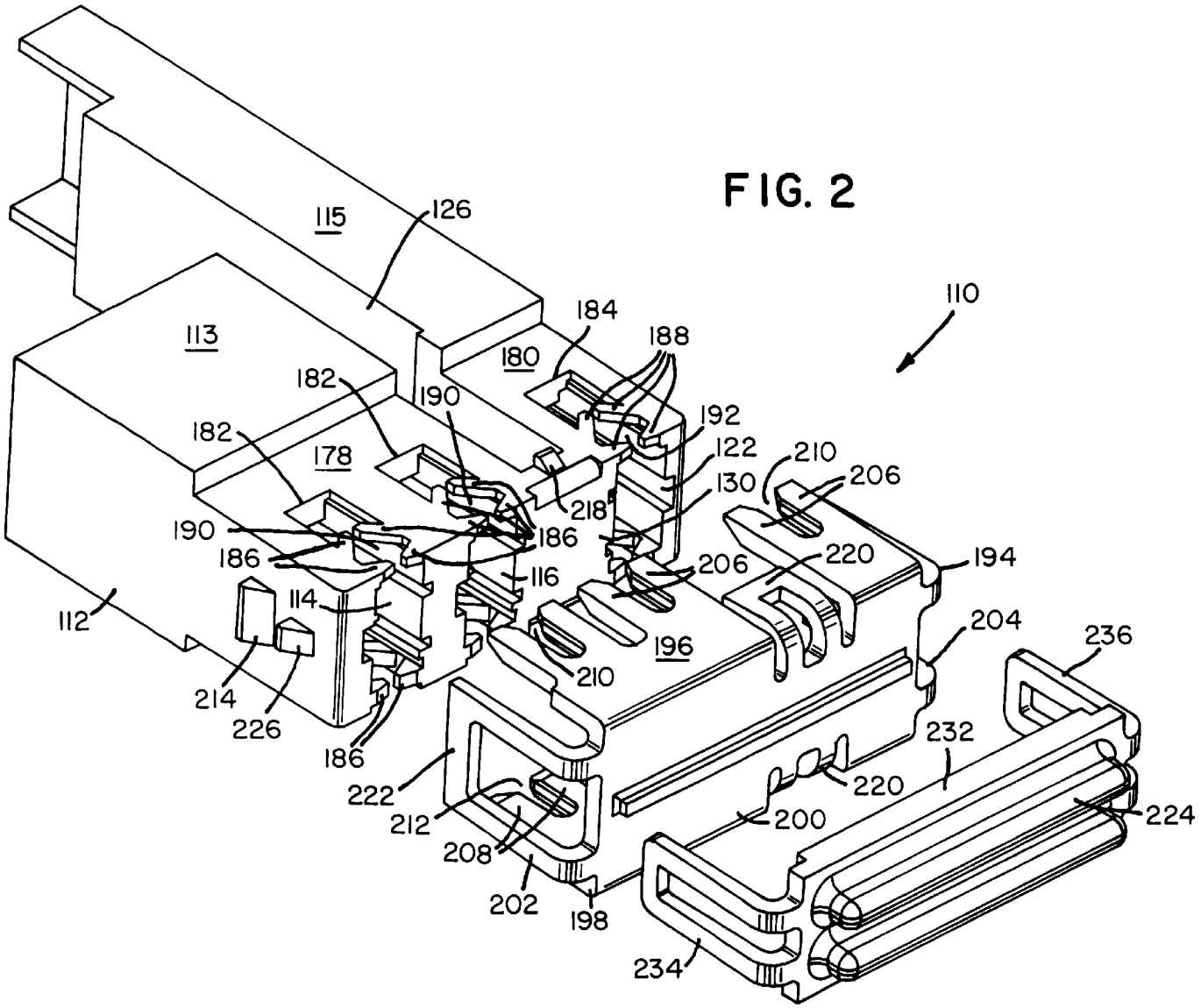
FIG. 2 is an exploded perspective view of the new and improved electrical switch connector assembly constructed in accordance with the principles and teachings of the present invention and showing the cooperative parts thereof.
Figure 3:
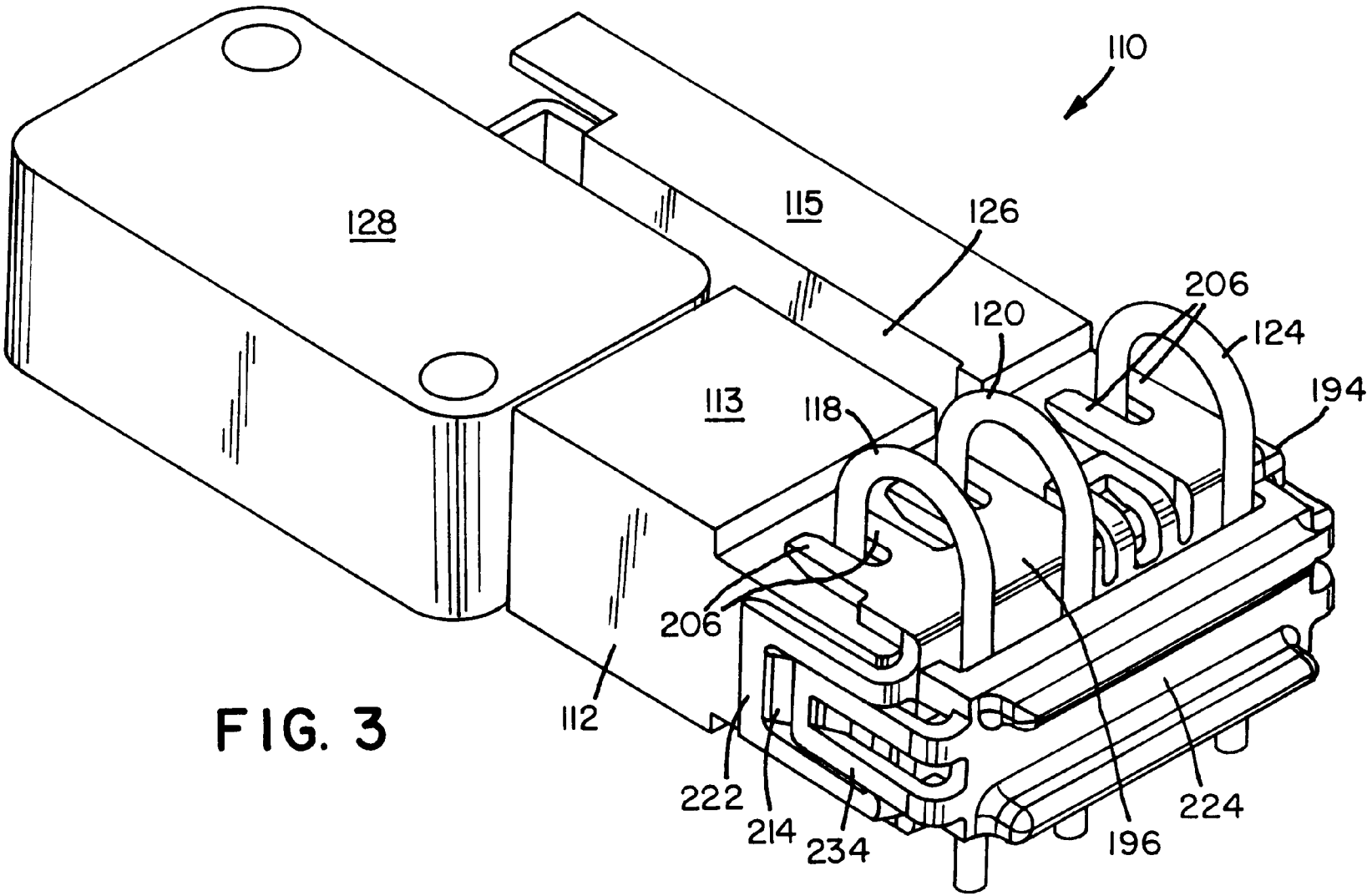
FIG. 3 is a perspective view of the new and improved electrical switch connector assembly shown in FIG. 2 when assembled together and operatively connected to a microswitch assembly or component.
Figure 4:
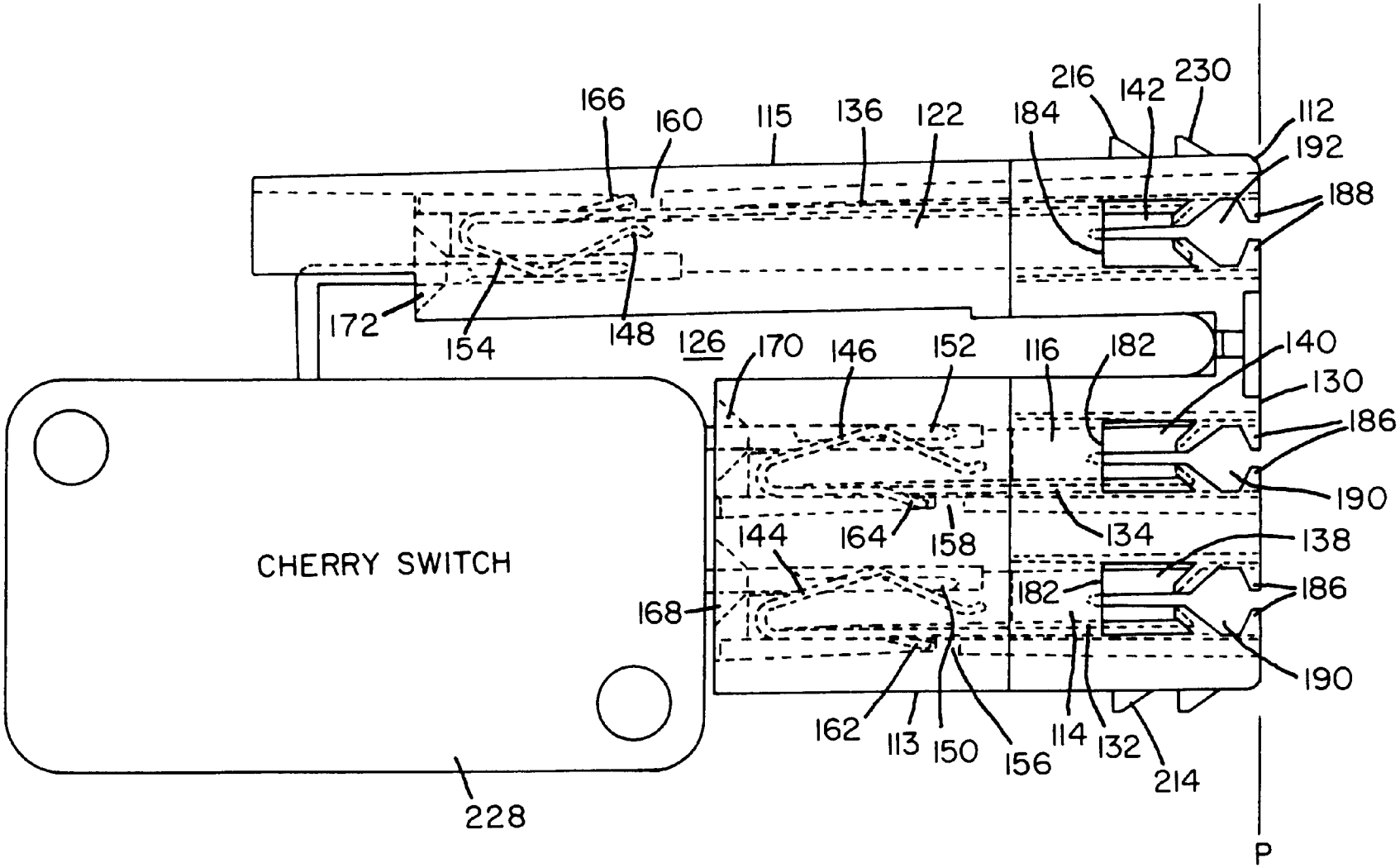
FIG. 4 is a top plan view of the housing member of the new and improved electrical switch connector assembly shown in FIGS. 2 and 3 wherein the housing member is illustrated as being operatively connected to a particularly configured microswitch assembly or component.
Figure 5:
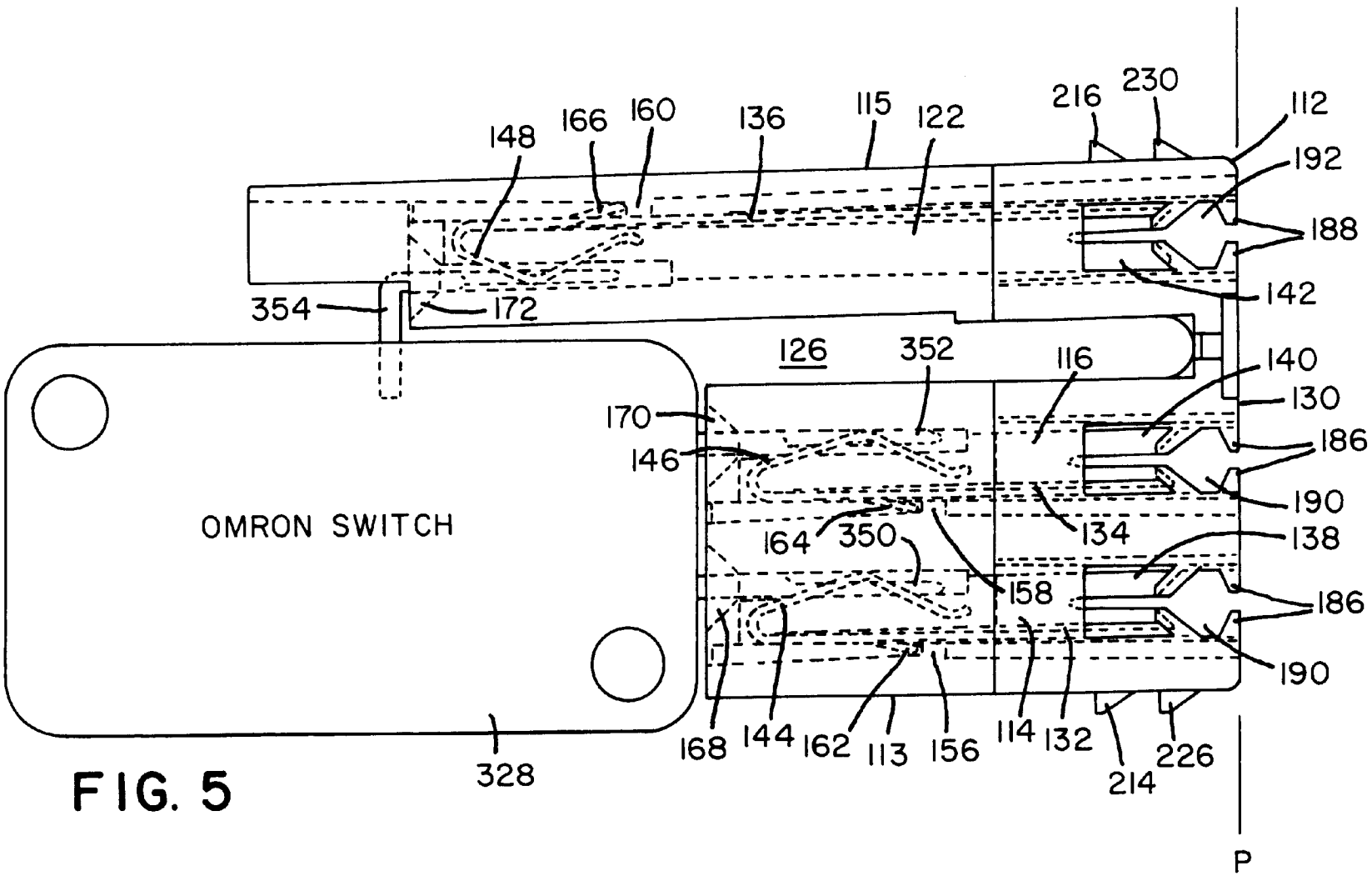
FIG. 5 is a top plan view similar to that of FIG. 4 showing, however, the housing member of the new and improved electrical switch connector assembly shown in FIGS. 2 and 3 wherein the housing member is illustrated as being operatively connected to another particularly configured microswitch assembly or component.

More particularly, it is seen from FIGS. 2–5 that the new and improved electrical switch connector assembly 110 constructed in accordance with the principles and teachings of the present invention comprises a housing 112 within which three axially extending electrical contact receptacles 114,116, and 122 are defined, the entire axial extent of the respective receptacles being best seen, for example, in FIGS. 4 and 5. As was the case with the housing 12 of the PRIOR ART electrical switch connector assembly 10 shown in FIG. 1, the housing 112 of the present invention electrical switch connector assembly 110 is seen to comprise a primary housing portion or section 113 within which the contact receptacles 114 and 116 are defined, and a secondary housing portion or section 115 within which the contact receptacle 122 is defined.

It is noted that the axial extent or length of the secondary housing portion or section 115 is substantially greater than the axial length or extent of the primary housing portion or section 113 such that the electrical switch connector assembly 110 can be properly mated with a well known microswitch element or component 128, as illustrated in FIG. 3, as will be discussed more fully shortly hereinafter. It is noted, however, that unlike the housing structure of the PRIOR ART electrical switch connector assembly 10 illustrated in FIG. 1, the secondary housing portion or section 115 is not axially offset with respect to the primary housing portion or section 113. As best seen from FIGS. 4 and 5, the open ends of the receptacles 114,116, and 122, within which the electrical wires are to be disposed and terminated as will be described shortly hereinafter, are all disposed within a common plane P. In addition, the primary housing portion or section 113 is separated from the secondary housing portion or section 115 by means of an axially extending slot or space 126 whereby the primary and secondary housing portions or sections 113 and 115 are only connected to each other by means of an integral connection portion or section 130. In this manner, the secondary housing portion or section 115 is resiliently and flexibly connected to the primary housing portion or section 113 in a substantially cantilevered manner.

Such cantilevered mounting of the secondary housing portion or section 115 upon the primary housing portion or section 113 permits the housing 112 to be properly electrically mated with microswitches which may be manufactured by different manufacturing companies and which may therefore exhibit slightly different configurations or size dimensions.

Figure 6:
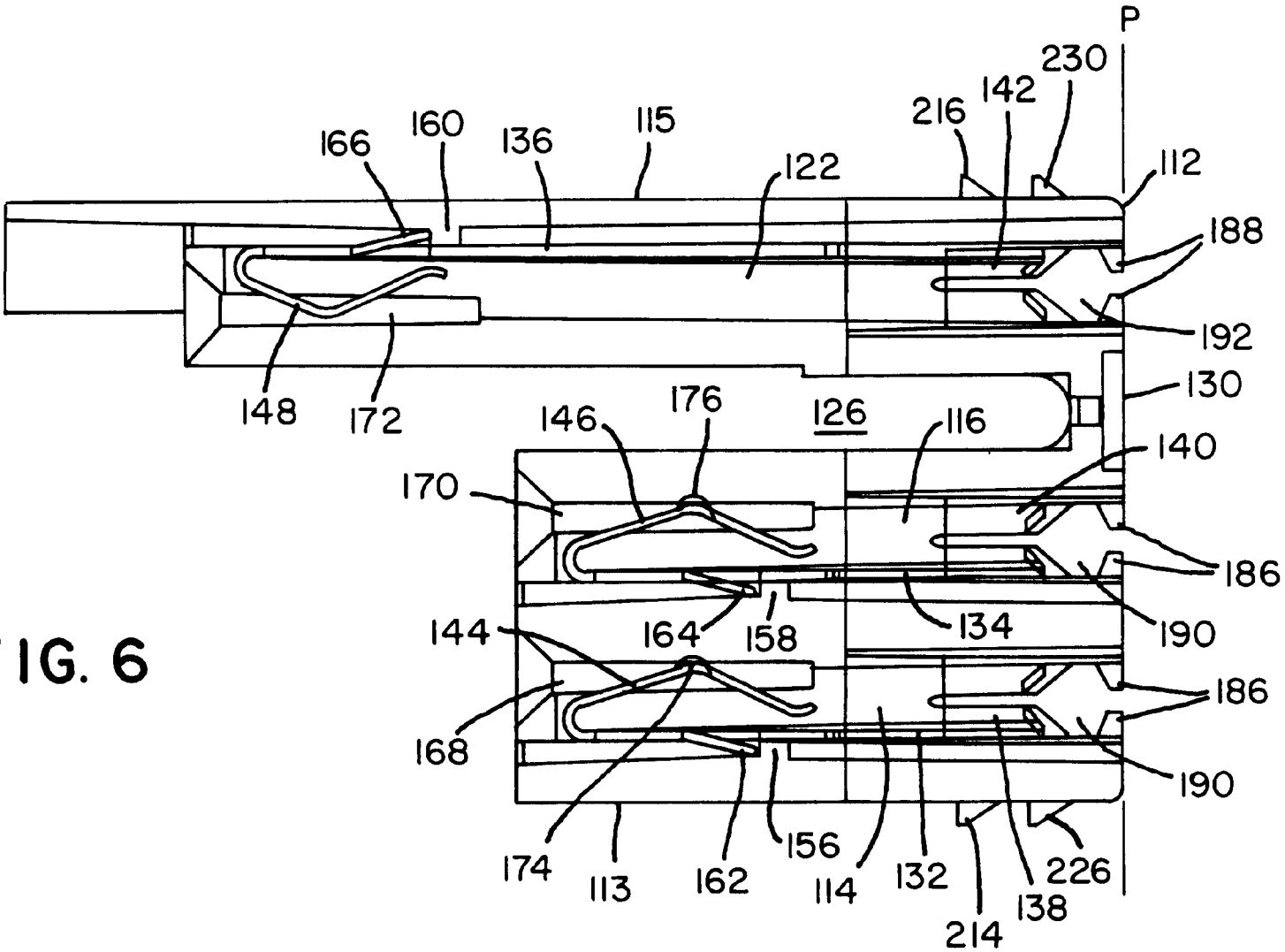
FIG. 6 is a horizontal cross-sectional view of the housing member of the electrical switch connector assembly of the present invention showing the mounting of the particular contact members of the electrical switch connector therein.

More particularly, as shown, for example, in FIGS. 4 and 6, the housing receptacles 114,116,122 are respectively provided with housing contact members 132,134,136, and it is appreciated that each one of the housing contact members 132, 134,136 is respectively provided with an insulation piercing or displacement end portion 138,140,142 for mating with electrical wires in a known manner, and a resiliently flexible leaf-spring end portion 144,146,148 for respectively mating with male prong members 150,152,154 of a microswitch element or component 228 as shown in FIG. 4. In order to fixedly retain the housing contact members 132,134,136 within the housing receptacles 114, 116,122, sidewall portions of the housing portions or sections 113,115 are respectively provided with detents 156,158,160 with which tab members 162,164,166 of the leaf-spring end portions 144,146,148 of the housing contact members 132, 134,136 snappingly engage. The sidewall portions of the housing portions or sections 113,115 are further respectively provided with axially extending bores or passages 168,170, 172 for accommodating the male prong members 150,152, 154 of the microswitch element or component 228. As clearly or best seen in FIG. 6, and in accordance with a unique feature of the present invention, the leaf-spring end portions 144,146 of the housing contact members 132,134 are provided with dimpled apex portions 174,176 which are adapted to snappingly engage within apertures, not shown, formed within the microswitch male prong members 150, 152. In this manner, a predetermined retention force is established or defined between the microswitch element or component 228 and the housing 112 of the electrical switch connector assembly 110 when the microswitch element or component 228 and the housing 112 are mated together. It is of course to be appreciated that in order to alter the aforenoted retention force with a different value, leaf-spring end portion 148 of housing contact member 136 could likewise be provided with a dimpled apex portion for insertion within a corresponding aperture formed within microswitch prong member 154, or still further, one of the dimpled apex portions 174,176 of the housing contact members 132,134 could be eliminated.

As a result of the aforenoted description of the housing structure, it is submitted that the mounted engagement or connection defined between the microswitch element or component 228 and the housing 112 is appreciated. However, it is to be appreciated further that as a result of the flexibly resilient cantilevered connection of the secondary housing portion or section 115 upon the primary housing portion or section 113, the housing 112 can be mated with or accommodate different microswitch elements or components manufactured by different manufacturing entities and having different structural characteristics or size dimensions. For example, with continued reference being made to FIG. 4, it is seen that the male prong member 154 of the microswitch element or component 228, which comprises a microswitch manufactured, for example, by CHERRY ELECTRICAL PRODUCTS of Waukegan, ILL., has a substantially L-shaped configuration, and that the short leg portion of the substantially L-shaped male prong member 154 has a predetermined length dimension such that when the microswitch element or component 228 is engaged or mated with the housing 112, and particularly, when the male prong member 154 is inserted within bore or passage 172 or secondary housing portion or section 115, the integral flexible connection portion 130 defined between the primary and secondary housing portions or sections 113, 115 permits the secondary housing portion or section 115 to be moved or biased slightly away from the primary housing portion or section 113. On the other hand, with reference being additionally made to FIG. 5, wherein there is disclosed a microswitch element or component 328 which may be manufactured, for example, by OMRON ELECTRONICS, INC. of Schaumburg, ILLINOIS, it is seen that the short leg portion of the substantially L-shaped male prong member 354 has a length which is somewhat smaller than that of the male prong member 154 of the microswitch component or element 228. Accordingly, the integral flexible connection portion 130 defined between the primary and secondary housing portions or sections 113,115 permits the secondary housing portion or section 115 to be moved or biased slightly toward the primary housing portion or section 113.

In a manner similar to that disclosed in connection with the PRIOR ART electrical switch connector assembly 10 disclosed within FIG. 1, the electrical switch connector assembly of the present invention is adapted to have electrical wires fixedly connected, mounted, or terminated within the housing 112. However, in accordance with unique structural features of the present invention, the termination or mounting operation or process of such electrical wires within the housing 112 of the electrical switch connector assembly 110 of the present invention is substantially simplified as compared to that of the PRIOR ART electrical switch connector assembly 10, is capable of being performed by automated equipment, and housing structure 112 is provided with unique strain relief means for effectively preventing strains or stresses, which may be impressed upon the electrical wires, from being transmitted to the connection points or locations at which the electrical wires are terminated or fixedly mounted within the housing 112.

With reference therefore being made to FIGS. 2–4, electrical wires 118,120,124 are respectively adapted to be mated with and terminated, connected, or mounted upon the insulation-piercing or displacement end portions 138,140, 142 of the housing contact members 132,134,136. In order to achieve such electrical wire termination, connection, or mounting, it is noted that the ends of the housing portions or sections 113, 115 within which the electrical wires are to be terminated or connected have upper wall portions 178,180, as best seen in FIG. 2, and lower wall portions, not shown, within which are defined substantially rectangular or square-shaped openings 182,184 which overlie and underlie the insulation-piercing or displacement end portions 138,140, 142 of the housing contact members 132,134,136. In addition, the upper wall portions 178, 180 of the housing portions or sections 113,115, as well as the lower wall portions, not shown, of the housing are further provided with pairs of oppositely disposed, somewhat flexible fingers 186,188 which serve to define apertures 190,192 which extend through the housing portions or sections 113,115 in a vertically transverse manner with respect to the axial extents thereof.

It is thus to be appreciated that when first ends of the electrical wires 118,120, 124 are to be mounted within the housing portions or sections 113,115, the first ends of the electrical wires 118,120,124 are initially inserted into the apertures 190,192 in the transverse direction whereby the fingers 186,188 serve to retain the first ends of the electrical wires 118,120, 124 at such axial positions in readiness for movement and insertion within the insulation piercing or displacement portions 138,140,142 of the housing contact members 132,134,136. It is to be noted that in view of the disposition of all of the forwardmost fingers 186,188 being disposed within the plane P, as seen, for example, in FIG. 4, and the horizontally transverse alignment of the apertures 190,192 within which the electrical wires 118,120,124 are initially held by means of the fingers 186,188, the assembly process of the present invention, whereby the electrical wires 118,120,124 can be inserted within the insulation-piercing or displacement portions 128,140,142 of the housing contact members 132,134,136, readily lends itself to performance by automated equipment whereby as a result of a single axial stroke of suitable components of such automated equipment, not shown, termination or connection of the electrical wires 118,120,124 upon the housing contact members 132,134, 136 is easily achieved. It is noted still further that in view of the vertically transverse disposition of the first ends of the electrical wires 118,120,124 through the apertures 190,192, additional in-line connections can be made to the electrical wires 118,120,124. This is not readily or easily achieved in conjunction with the electrical wires 18,20,24 of the PRIOR ART electrical switch connector assembly of FIG. 1 because the terminal ends of the wires 18, 20,24 have the housing contacts crimped thereon.

With continued reference being made to FIGS. 2 and 3, in order to effectively retain the electrical wires 118,120, 124 at their axial positions at which the electrical wires 118, 120,124 are terminated upon the insulation displacement or piercing portions 138,140,142 of the housing contact members 132,134,136, a cover member 194 is adapted to be mounted upon the housing 112. The cover member 194 is seen to substantially comprise a five-sided component which includes a top wall member 196, a bottom wall member 198, a front wall member 200, and a pair of opposite side wall members 202,204. The top and bottom wall members 196, 198 are each provided with pairs of laterally spaced fingers 206,208, with slots 210,212 defined between each pair or set of fingers 206,208 so as to accommodate the electrical wires 118,120,124 in an interdigitated manner as best seen in FIG. 3. In this manner, the electrical wires 118,120,124 are effectively trapped between the ends of slots 210,212 on the one hand, and the ends of the slots, not numbered, defined within the insulation-piercing or displacement contact members 138,140,142 so as to thereby be retained within the housing assembly. In order to securely but removably mount the cover member 194 upon the housing 112, primary housing portion or section 113 is provided with a detent 214 and secondary housing portion or section 115 is provided with a detent 216 as seen, for example, in FIGS. 4–6. The upper and lower surface regions of the integral connection portion 130 defined between the primary and secondary housing portions or sections 113,115 are also provided with detents 218, although the bottom detent is not shown. The upper and lower regions of the cover member 194, defined between the pairs of fingers 206,208 cooperating with the electrical wires 120,124, are provided with flexible framework configured snap-engaging latch members 220 which effectively surround and snap-engagingly mate with the detents 218, and the side walls 202,204 are likewise formed as flexible framework configured snap-engaging latch members 222 which surround and snap-engagingly mate with the detents 214,216.

In accordance with another unique feature of the present invention, a strain relief member 224 is adapted to be mounted upon the housing 112 and is adapted to cooperate with the cover member 194 so as to provide strain relief characteristics with respect to the electrical wires 118,120, 124. More particularly, as best seen in FIG. 3, once the first ends of the electrical wires 118,120,124 are mounted within the insulation-piercing or displacement portions 138,140, 142 of the housing contact members 132,134,136, and the cover member 194 is affixed upon the housing 112, the electrical wires 118,120,124 can be bent or folded over the top wall member 196 of the cover member 194 and routed downwardly along the front wall member 200 of the cover member 194 whereupon the strain relief member 224 can be mounted upon the housing 112 such that the strain relief member 224 and the cover member 194 together effectively provide strain relief characteristics to the free end portions of the electrical wires 118,120,124. In order to secure or mount the strain relief member 224 upon the housing 112 so as to cooperate with the cover member 194 in performing the strain relief characteristics for the electrical wires 118,120, 124, the primary and secondary housing portions or sections 113,115 are respectively further provided with detents 226, 230 which are located adjacent to or within the vicinity of the detents 214,216 as seen in FIGS. 2 and 4–6. The strain relief member 224 is seen to comprise a substantially three-sided or three-walled member including a front wall 232 for cooperating with the front wall 200 of the cover member 194 in an overlying manner, and a pair of side walls 234,236. The side walls 234,236 are configured substantially the same as the side walls 202,204 of the cover member 194 in that the same effectively comprise flexible framework members which surround and snap-engagingly mate with the detents 226,230 once the cover member 194 and the strain relief member 224 are mounted upon the housing 112 as shown in FIG. 3. It is specifically noted that the vertical extents or dimensions of the side walls 234,236 of the strain relief member 224 are less than those of the side walls 202,204 such that the side walls 234,236 can in effect be internally housed or accommodated within the framework structure defined by the cover member side walls 202,204 as is also clearly illustrated in FIG. 3.

Figure 7:
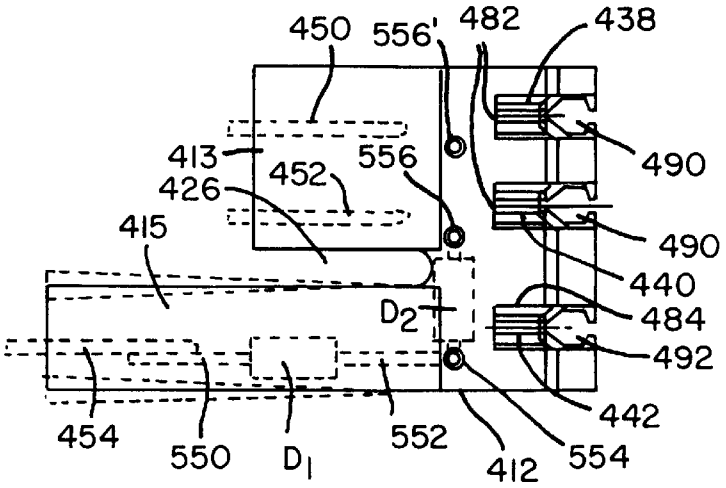
FIG. 7 is a top plan view of a housing member, similar to the housing members shown in FIGS. 4 and 5, showing, however, the optional mounting of an auxiliary electrical component upon the underside of the housing member of the electrical switch connector assembly wherein the auxiliary electrical component may be mounted at either one of two locations upon the housing member.
Figure 8:
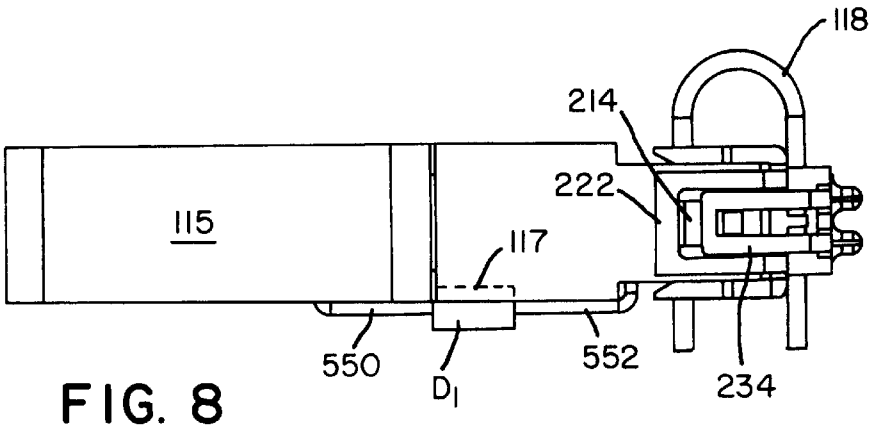
FIG. 8 is a side elevation view of the assembled electrical switch connector assembly illustrated in FIG. 3 showing, however, the optional mounting of an auxiliary electrical component upon the underside of the housing member of the electrical switch connector assembly.

As a last feature of the present invention, and with particular reference being made to FIGS. 7 and 8, the structural arrangement of the electrical switch connector assembly is such as to permit auxiliary electrical components to be physically mounted upon the housing so as to be electrically within the system or assembly in, for example, either one of two different modes. It is firstly noted in connection with the housing illustrated in FIG. 7 that the housing is, in effect, a mirror-image housing of the housing 112 disclosed within FIGS. 2–6, and accordingly, the housing of FIG. 7 has been designated by the reference character 412. In addition, the other corresponding parts of the housing have also been noted by reference characters within the 400 series, and for clarity purposes, not all parts of the housing 412 have been designated by reference characters. It is further noted for achieving a better understanding of the mounting of the auxiliary electrical components upon the housing 412 that male prong members, from a suitable microswitch element or component, not shown in FIG. 7, have been designated by the reference characters 450,452, 454.

Continuing further then, and as more particularly illustrated in FIG. 7, an auxiliary electrical component, such as, for example, a diode, may be mounted upon the housing 412 in either one of two different modes. When the diode is mounted, for example, as an in-line diode $D_1$ a first prong 550 of the diode $D_1$ has an end portion thereof which extends vertically upwardly through the secondary housing portion or section 415 and is disposed in contact with the male prong member 454 of the microswitch, while a second prong 552 of the diode $D_1$ has an end portion which similarly extends upwardly through the secondary housing portion or section 415 and is disposed in contact with a portion, not shown, of the housing contact member 442. Alternatively, if the diode is to be mounted, for example, upon the housing 412 as a jumper diode $D_2$, then a first prong member 554 of the jumper diode $D_2$ would have an end portion thereof extending upwardly through the secondary housing portion or section 415 so as to be disposed in contact with a portion of the housing contact member 442 in a manner similar to that of second prong 552 of the in-line diode $D_1$, while a second prong member 556 of the jumper diode $D_2$ would have an end portion thereof extending upwardly through the primary housing portion or section 413 so as to be disposed in contact with a portion, not shown, of the housing contact member 440 whereby the jumper diode $D_2$ would, in effect, be electrically connected between the housing contact members 440 and 442. Still further and alternatively, the jumper diode $D_2$ can be electrically interconnected between the housing contact members 442 and 438 as a result of the first prong member 554 would be disposed in electrical contact with housing contact member 442 while the second prong member, designated by the reference character 556' for clarity purposes, would be disposed in electrical contact with housing contact member 438. In FIG. 8, the in-line diode $D_1$ is illustrated as being mounted upon the underside of the secondary housing portion or section 115, and it is seen that the upper end portion of the diode $D_1$ is housed within a recessed region 117 of the secondary housing portion or section 115.

Thus, it may be seen that in accordance with the principles and teachings of the present invention, there has been developed a new and improved electrical switch connector assembly wherein the electrical wires to be terminated upon the housing contact members may be readily and easily mounted within the assembly housing by means of automated equipment, and a unique cover and strain relief arrangement may be mounted upon the housing so as to retain the electrical wires therewithin in a strain relief mode. In addition, the housing contact members are provided with dimpled structure for interengaging the prong members of the microswitch components or elements with a predetermined amount of retention force, and the housing is divided into two portions or sections so as to exhibit a predetermined amount of resilient flexibility whereby the same can be mated or used in conjunction with different microswitch components or elements manufactured by different manufacturers and characterized by different size dimensions or configurations. Still further, auxiliary electrical components may be mounted upon the housing in either one of two different modes.

Obviously, many variations and modifications of the present invention are possible in light of the above teachings. For example, while the snap-engaging detents are illustrated as being mounted upon the side walls of the housing portions or sections so as to secure the cover and strain relief members thereon, it is also possible to provide such detents upon the upper and lower surfaces of the housing portions or sections. It is therefore to be understood that within the scope of the appended claims, the present invention may be practiced otherwise than as specifically described herein.

What is claimed as new and desired to be protected by Letters Patent of the United States of America, is:

1. An electrical switch connector assembly for electrical connection with an electrical switch, comprising:

a housing having first and second mounting members fixed thereon;

a plurality of electrical wires disposed within said housing;

a plurality of contact members disposed within said housing and having first end portions thereof respectively connected to said plurality of electrical wires at predetermined locations, and having second end portions thereof for connection to contacts of an electrical switch;

cover means engaged with said first mounting members of said housing so as to be mounted upon said housing for cooperating with said housing so as to retain said plurality of electrical wires mounted within said housing; and strain relief means engaged with said second mounting members of said housing so as to be mounted upon said housing for cooperating with said cover means so as to provide strain relief characteristics to said plurality of electrical wires and thereby prevent strains impressed upon said plurality of electrical wires from being transmitted to said predetermined locations at which said plurality of electrical wires are connected to said first end portions of said plurality of contact members.

2. An assembly as set forth in claim 1, wherein:

said housing comprises primary and secondary housing portions; and means integrally interconnecting one end of said secondary housing portion to said primary housing portion in a flexible cantilevered manner such that said housing can be electrically mated with switch components having different size dimensions and structural configurations.

3. An assembly as set forth in claim 1, wherein:

said first end portions of said plurality of contact members comprise slotted insulation-piercing contact portions.

4. An assembly as set forth in claim 3, wherein:

said cover means comprises a plurality of fingers, separated by slots defined therebetween, whereby said plurality of fingers are disposed in an interdigitated manner with respect to said plurality of electrical wires when said cover means is mounted upon said housing, and said plurality of wires are maintained mounted upon said housing as a result of being effectively trapped between end portions of said slots defined between said plurality of fingers of said cover means and between end portions of slots defined within said slotted insulation-piercing contact portions of said plurality of contact members.

5. An assembly as set forth in claim 3, wherein:

said housing comprises a plurality of fingers for retaining said plurality of electrical wires at predetermined positions within said housing prior to terminated connection of said plurality of electrical wires with said slotted insulation-piercing contact portions of said plurality of contact members.

6. An assembly as set forth in claim 1, wherein:

said first and second mounting members of said housing comprise first and second detent means mounted upon said housing for engaging said cover means and said strain relief means; and said cover means and said strain relief means each comprise flexible engagement means for snap-engaging said first and second detent means mounted upon said housing such that said cover means and said strain-relief means are retained in their mounted positions upon said housing.

7. An assembly as set forth in claim 6, wherein:

said flexible engagement means of said cover means and said strain relief means, for snap-engaging said first and second detent means mounted upon said housing, respectively comprise first and second framework members surrounding said first and second detent means mounted upon said housing.

8. An assembly as set forth in claim 7, wherein:

said second framework member of said strain-relief means is disposed internally of said first framework member of said cover means when said cover means and said strain-relief means are mounted upon said housing.

9. An assembly as set forth in claim 1, further comprising:

an auxiliary electrical component mounted upon an external surface of said housing.

10. An assembly as set forth in claim 9, wherein:

said auxiliary electrical component comprises an inline diode for electrical interconnection between one of said plurality of contact members of said housing and a contact member of an electrical switch with which said electrical switch connector assembly is to be electrically connected.

11. An assembly as set forth in claim 9, wherein:

said auxiliary electrical component comprises a jumper diode electrically interconnected between two of said plurality of housing contact members.

12. An electrical switch connector assembly for electrical connection with an electrical switch, comprising:

a housing having first and second mounting members fixed thereon;

a plurality of electrical wires disposed within said housing;

a plurality of contact members disposed within said housing and having first end portions thereof respectively connected to said plurality of electrical wires at predetermined locations, and having second end portions thereof for connection to contacts of an electrical switch;

cover means engaged with said first mounting members of said housing so as to be mounted upon said housing for cooperating with said housing so as to retain said plurality of electrical wires mounted within said housing; and strain relief means engaged with said second mounting members of said housing and overlying said cover means for cooperating with said cover means so as to provide strain relief characteristics to said plurality of electrical wires and thereby prevent strains impressed upon said plurality of electrical wires from being transmitted to said predetermined locations at which said plurality of electrical wires are connected to said first end portions of said plurality of contact members.

13. An assembly as set forth in claim 12, wherein:

said first end portions of said plurality of contact members comprise slotted insulation-piercing contact portions.

14. An assembly as set forth in claim 13, wherein:

said cover means comprises a plurality of fingers, separated by slots defined therebetween, whereby said plurality of fingers are disposed in an interdigitated manner with respect to said plurality of electrical wires when said cover means is mounted upon said housing, and said plurality of wires are retained mounted upon said housing as a result of being effectively trapped between end portions of said slots defined between said plurality of fingers of said cover means and between end portions of slots defined within said slotted insulation-piercing contact portions of said plurality of contact members.

15. An assembly as set forth in claim 13, wherein:

said housing comprises a plurality of fingers for retaining said plurality of electrical wires at predetermined positions within said housing prior to terminated connection of said plurality of electrical wires with said slotted insulation-piercing contact portions of said plurality of contact members.

16. An assembly as set forth in claim 12, wherein:

said first and second mounting members of said housing comprise first and second detent means mounted upon said housing for engaging said cover means and said strain relief means; and said cover means and said strain relief means each comprise flexible engagement means for snap-engaging said first and second detent means mounted upon said housing such that said cover means and said strain-relief means are retained in their mounted positions upon said housing.

17. An assembly as set forth in claim 16, wherein:

said flexible engagement means of said cover means and said strain relief means, for snap-engaging said first and second detent means mounted upon said housing, respectively comprise first and second framework members surrounding said first and second detent means mounted upon said housing.

18. An assembly as set forth in claim 17, wherein:

said second framework member of said strain-relief means is disposed internally of said first framework member of said cover means when said cover means and said strain-relief means are mounted upon said housing.

* * * * *